United States Patent [19]

Haskell

[11] 4,254,566

[45] Mar. 10, 1981

[54] JOGGER AND RUNNER SHOE IDENTIFICATION

[76] Inventor: Sylvan K. Haskell, 624 Ellsworth Pl., Pittsburgh, Pa. 15232

[21] Appl. No.: 31,581

[22] Filed: Apr. 19, 1979

[51] Int. Cl.³ ..... A44C 3/00

[52] U.S. Cl. ..... 40/2 E; 40/20 R

[58] Field of Search ..... 24/117, 119; 40/2 E, 40/2 R, 586

[56] References Cited

U.S. PATENT DOCUMENTS

| | | | |
|---|---|---|---|
| 528,464 | 10/1894 | Craig | 24/119 X |
| 2,095,869 | 10/1937 | Hermson | 40/2 E X |
| 2,871,537 | 2/1959 | Hickerson | 24/117 R |

FOREIGN PATENT DOCUMENTS

| | | | |
|---|---|---|---|
| 4256 | of 1903 | United Kingdom | 24/119 |

*Primary Examiner*—Gene Mancene

*Assistant Examiner*—Wenceslao J. Contreras

*Attorney, Agent, or Firm*—Buell, Blenko, Ziesenheim & Beck

[57] ABSTRACT

A jogger and runner shoe identification device is provided in the form of an elongate flexible and foldable sheet member having a weakened portion intermediate its length defining a bending line, at least one indicia receiving surface on said sheet whereby a wearer's name, address and pertinent medical information may be applied thereon and shoe lace receiving means in said sheet spaced from one end engageable upon laces of a shoe, the other end of said sheet being slidable beneath said laces between the laces and tongue of a shoe.

7 Claims, 5 Drawing Figures

JOGGER AND RUNNER SHOE IDENTIFICATION

This invention relates to Jogger and Runner Shoe Identification and particularly to an identification device for use within the tongue and lace area of a shoe and which is held in place by the shoe laces.

The practice of running and/or jogging as a means of physical fitness improvement has reached major proportions in many areas of the world.

Much of the running and jogging which is being done is along travelled thoroughfares and many times in areas where the runner or jogger is unknown. The danger of an accident occurring is always present and frequently neither the identity of nor pertinent medical facts are available. A simple, inexpensive device for providing such information, which is attached to the runner or jogger has long been needed.

The idea of attaching an identification device to footwear is not new. For example, Smith in U.S. Pat. No. 2,616,189 provides a footwear identification plate which is attached around a hunting boot by means of an ankle embracing harness and an identification tag which passes beneath the shoe arch between heel and sole and is suspended from said harness by a plurality of wires. Such a device may be satisfactory for a heavy hunting boot, but it is totally unacceptable on a running shoe.

I have invented an identification device which is light in weight, inexpensive, which can carry the runner's name, address, phone number and pertinent medical facts and which can be readily attached to a shoe in removable fashion but which will not separate from the shoe unless intentionally removed.

I provide an elongate flexible and foldable sheet member having a weekened portion defining a bending line intermediate its length transverse to the length of said sheet member, at least one indicia receiving surface on said sheet whereby the wearer's name, address and medical facts may be applied thereon, and shoe lace receiving means on said sheet engageable upon laces in a shoe to hold one end in position over the shoe laces, the other end being slidable beneath said laces. Preferably the line of weakening is about $\frac{1}{3}$ the length of the member and is formed by notching opposing sides of said member. The longer $\frac{2}{3}$ portion is adapted to be slid beneath the shoe laces and the smaller $\frac{1}{3}$ portion is perforated with two spaced holes receiving the ends of shoe laces on which applied. The member is preferably made of paper with one side exposed to receiving writing or printing and the other side is coated with a plastic protective coating such as mylar.

In the foregoing general description of my invention, I have set out certain objects, purposes and advantages of my invention. Other objects purposes and advantages of this invention will be apparent from a consideration of the following description and the accompanying drawings in which.

Figure 1:
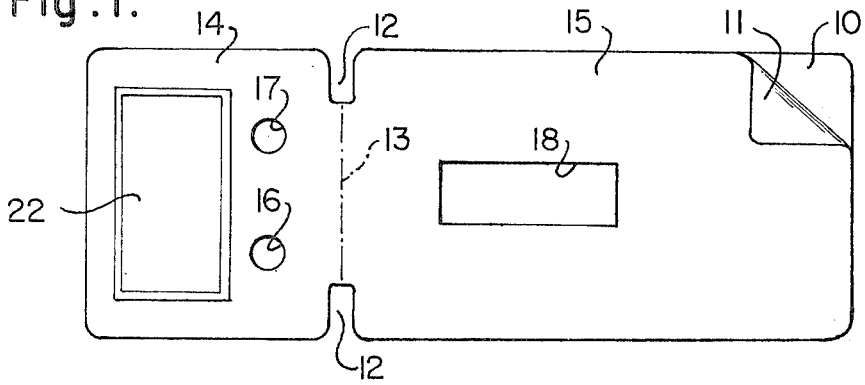
FIG. 1 is a top plan view of a shoe identification device according to this invention.
Figure 2:
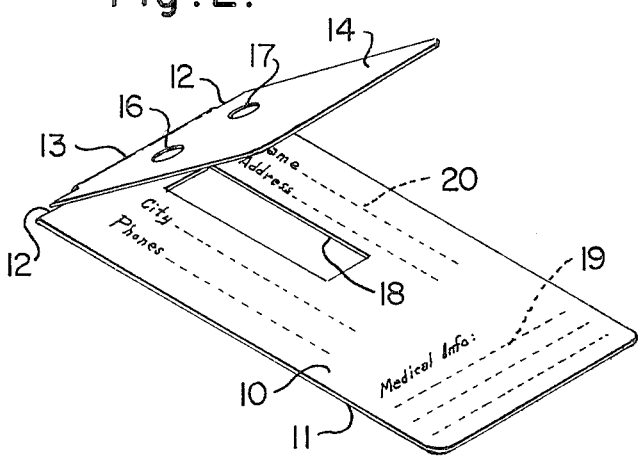
FIG. 2 is an isometric view of the device of FIG. 1 ready for insertion into a runner's shoe.

Referring to the drawings, I have illustrated a preferred form of my invention in the form of a generally elongate rectangular sheet of paper 10 laminated to a sheet of mylar 11. Both sheets 10 and 11 are notched 12 intermediate their ends about $\frac{1}{3}$ of the distance from one end to form a line of weakening 13 around which the two ends 14 and 15 are folded. The shorter end 14 is provided with two spaced apart holes 16 and 17 through which the ends of the laces are passed prior to tying. The other end 15 is provided with an elongate rectangular slot 18 which may, if desired, be incorporated in the laces or it may be unused, depending upon the desires of the user.

The exposed paper surface 10 is provided with lines for medical information 19 and with lines for name and address 20. The plastic surface 11 is preferably provided with advertising or some other indicia 22.

In use the user's name and address are typed or otherwise applied to line 20 and pertinent medical information, such as blood type, allergies, diabetes and the like are applied to line 19. The long end 15 is then inserted with the plastic side 11 down on top of the tongue of the shoe beneath laces 23 with the short end 14 hanging over the front of the shoe. The shoe lace ends 24 are then passed through openings 16 and 17 before the final bow is tied in the laces and the device is fastened by tying a bow in the shoe lace ends 24 in the usual manner.

Figure 4:
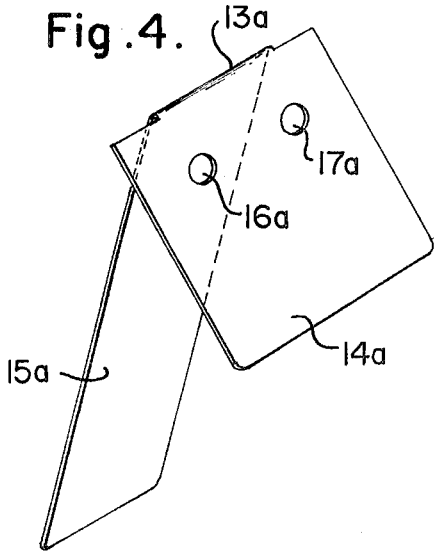
FIG. 4 is an isometric view of a second embodiment of this invention.

In FIG. 4, I have illustrated another embodiment in which the long portion **15*a* is of narrower width than portion 14*a* and the line of weakening is created by the junction 13*a* of these two portions. The rectangular slot 18 of FIG. 1** embodiment is also absent. Otherwise, the two structures are essentially the same and are used in precisely the same manner.

Figure 5:
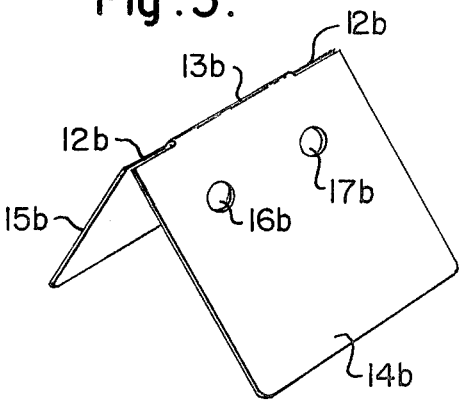
FIG. 5 is an isometric view of a third embodiment.
Figure 3:
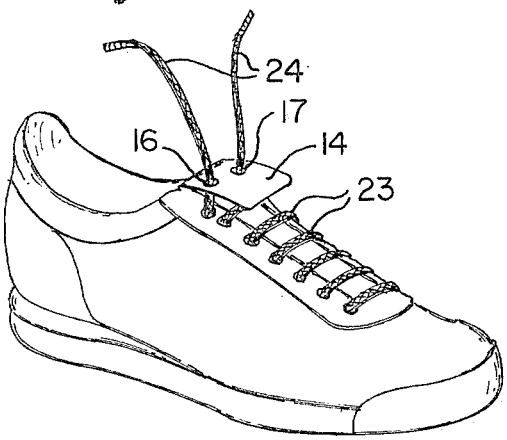
FIG. 3 is an isometric view of the device of FIG. 1 installed on a runner or jogger's shoe.

In FIG. 5, I have illustrated a third embodiment in which both portions **14*b* and 15*b* are the same length. A line of weakening is created by notches 12*b*. This embodiment is used in the same fashion as that of FIG. 1** but is less desirable and not my preferred form.

In the foregoing specification, I have set out certain preferred practices and embodiments of my invention, however, it will be understood that this invention may be otherwise embodied within the scope of the following claims.

I claim:

1. In combination a jogger and runner shoe having a front laced opening overlying a tongue portion and an identification device comprising an elongate flexible and foldable sheet member having a weakened portion intermediate its length defining a bending line, at least one indicia receiving surface on said sheet on one side of said weakened portion whereby a wearer's name, address and pertinent medical information may be applied thereon and shoe lace receiving means in said sheet on the other side of said weakened portion and spaced from one end engageable upon laces of said shoe, the indicia receiving surface of said sheet being slidable beneath a substantial portion of said laces between the laces and tongue of said shoe and overlaid by said shoe lace receiving portion whereby said indicia receiving portion is protected against unauthorized removal and damage over at least a portion of its surface.

2. A jogger and runner shoe identification device as claimed in claim 1 in which the sheet member is made up of a sheet of plastic and a sheet of paper laminated together to form a single sheet.

3. A jogger and runner shoe identification device as claimed in claim 1 wherein the sheet member is a sheet of paper coated on one side with a film of plastic.

4. A jogger and runner shoe identification device as claimed in claim 1 or 2 or 3 wherein the sheet is notched intermediate its ends to provide said weakened portion.

5. A jogger and runner shoe identification device as claimed in claim 4 wherein the notches are spaced from one end about ⅓ the length of the sheet.

6. A jogger and runner shoe identification device as claimed in claim 1 or 2 or 3 wherein the shoe lace receiving means is a pair of spaced holes adjacent the line of weakening on one end of said member.

7. In combination a jogger and runner shoe having an upper with a lace closure, a tongue and laces in said closure and an identification device, the improvement comprising said identification device being an elongate flexible and foldable sheet member having a weakened portion intermediate its length defining a bending line, at least one indicia receiving surface on said sheet on one side of said weakened portion whereby a wearer's name, address and pertinent medical information may be applied thereon, said line of weakening separating said sheet into a first portion carrying said at least one indicia receiving surface and lying between the tongue and a substantial portion of the laces of the shoe and a second portion overlying said laces, said second portion having a pair of spaced openings receiving the ends of said laces prior to tying a fastening bow in said laces whereby the first portion is overlaid by said second portion and the indicia receiving means is protected against unauthorized removal and against damage over at least a portion of its surface.

* * * * *